US005588413A

United States Patent [19]

Stone et al.

[11] Patent Number: 5,588,413

[45] Date of Patent: Dec. 31, 1996

[54] ENGINE ASSEMBLY WITH LEAF SPRING CAM FOLLOWER

[75] Inventors: Dwight V. Stone, East Peoria, Ill.; Douglas A. Long, Delphi, Ind.; Jose M. Salazar-Vior, Washington, Ill.

[73] Assignee: Caterpillar Inc., Peoria, Ill.

[21] Appl. No.: 404,025

[22] Filed: Mar. 14, 1995

[51] Int. Cl.[6] ..... F02M 37/04

[52] U.S. Cl. ..... 123/508; 123/90.36; 123/509

[58] Field of Search ..... 123/508, 509, 123/90.36, 90.45, 507, 90.61, 90.49, 90.55

[56] References Cited

U.S. PATENT DOCUMENTS

| | | | |
|---|---|---|---|
| 1,259,263 | 3/1918 | Merrick | 123/90.49 |
| 1,270,941 | 7/1918 | Goodwin | 123/90.49 |
| 1,648,742 | 11/1927 | Schlesser . | |
| 1,691,991 | 11/1928 | Pockett | 123/90.49 |
| 1,699,659 | 1/1929 | Fagan | 123/90.36 |
| 2,931,347 | 4/1960 | Williams | 123/90.55 |
| 4,538,561 | 9/1985 | Amemori | 123/508 |
| 4,624,223 | 11/1986 | Wherry | 123/90.36 |
| 4,864,983 | 9/1989 | Breitbarth | 123/90.61 |
| 4,944,275 | 7/1990 | Perr | 123/508 |
| 5,035,209 | 7/1991 | Braker et al. | 123/90.61 |

FOREIGN PATENT DOCUMENTS

| | | | |
|---|---|---|---|
| 238897 | 12/1959 | Australia | 123/90.45 |
| 1629574 | 2/1991 | U.S.S.R. | 123/90.45 |
| 1437285 | 5/1976 | United Kingdom | 123/90.36 |
| WO20748 | 9/1994 | WIPO | 123/507 |

*Primary Examiner*—Carl S. Miller

*Attorney, Agent, or Firm*—Marshall O'Toole Gerstein Murray & Borun; Alan J. Hickman

[57] ABSTRACT

An engine assembly having an engine block with at least one cylinder disposed therein, a fuel injector for periodically injecting fuel into the cylinder, a vertically disposed pushrod, a rocker arm disposed for periodic movement and having a first end disposed adjacent the fuel injector and a second end disposed adjacent the pushrod, a camshaft having a cam, and a leaf spring cam follower operatively coupled between the cam and the pushrod. The cam follower has a first portion which supports a cam roller and a second portion which makes contact with the pushrod. The first and second portions of the cam follower, which are spring-biased with respect to each other, may comprise, respectively, a rigid curved member and a flexible, substantially planar member.

15 Claims, 3 Drawing Sheets

ENGINE ASSEMBLY WITH LEAF SPRING CAM FOLLOWER

TECHNICAL FIELD

The present invention is directed to an engine assembly for a mechanically actuated fuel injector of the type having a fuel injector and an injector train having a rocker arm, a pushrod, a camshaft with a cam, and a cam follower.

BACKGROUND ART

Mechanically actuated fuel injectors in conventional engine assemblies typically incorporate an injector train having a rocker arm with two ends, one of which is mechanically coupled to the fuel injector and the other of which is mechanically coupled to a pushrod. The pushrod is coupled to an cam follower which engages an eccentric cam on the engine camshaft.

The rotation of the camshaft and the eccentric cam causes the cam follower, the pushrod, and the rocker arm to reciprocate. The reciprocation of the rocker arm causes the fuel injector to periodically inject fuel into the engine cylinder with which it is associated. One example of such an engine assembly is disclosed in U.S. Pat. No. 5,035,209 to Braker, et al.

In some engine assemblies of the type described above, there may be some intermittent, slight mechanical separation between the components of the injector train. For example, during each fuel injection cycle, the rocker arm may become temporarily separated from the pushrod. That temporary separation, which lasts for only a portion of the fuel injection cycle, may cause excessive noise when the pushrod again makes contact with the rocker arm later in the injection cycle. The temporary separation of the injector train components may have other disadvantages.

DISCLOSURE OF THE INVENTION

The invention is directed to an engine assembly having an engine block with a cylinder disposed therein, a fuel injector for periodically injecting fuel into the cylinder, a pushrod, a rocker arm disposed for periodic movement and having a first end and a second end, the first end of the rocker arm being disposed adjacent the fuel injector and the second end of the rocker arm being disposed adjacent the pushrod, a camshaft having a cam, and a leaf-spring cam follower operatively coupled between the cam and the pushrod. The cam follower has a first portion which supports a cam roller and a second portion which makes contact with the pushrod, and the first and second portions of the cam follower are spring-biased with respect to each other. Consequently, any noise due to the temporary separation of the injector train components is reduced or eliminated since those components are forced, by the leaf-spring cam follower, to always make contact with each other.

The first portion of the cam follower may comprise a rigid, curved member, and the second portion of the cam follower may comprise a flexible, substantially planar member. The second portion of the cam follower may also have a cup with a concave cavity attached to the flexible plate to support the lower end of the pushrod.

The cam follower may have means for supplying oil between the first and second portions of the cam follower which may comprise a shaft having a hollow, oil-containing central portion which passes through a bore in the first portion of the cam follower and one or more bores which fluidly connect the oil-containing central portion with the intersection of the first and second portions of the cam follower. The means for supplying oil between the first and second portions of the cam follower may additionally comprise an oil cavity formed in an upper surface of the first portion of the cam follower.

BEST MODE FOR CARRYING OUT THE INVENTION

Figure 1:
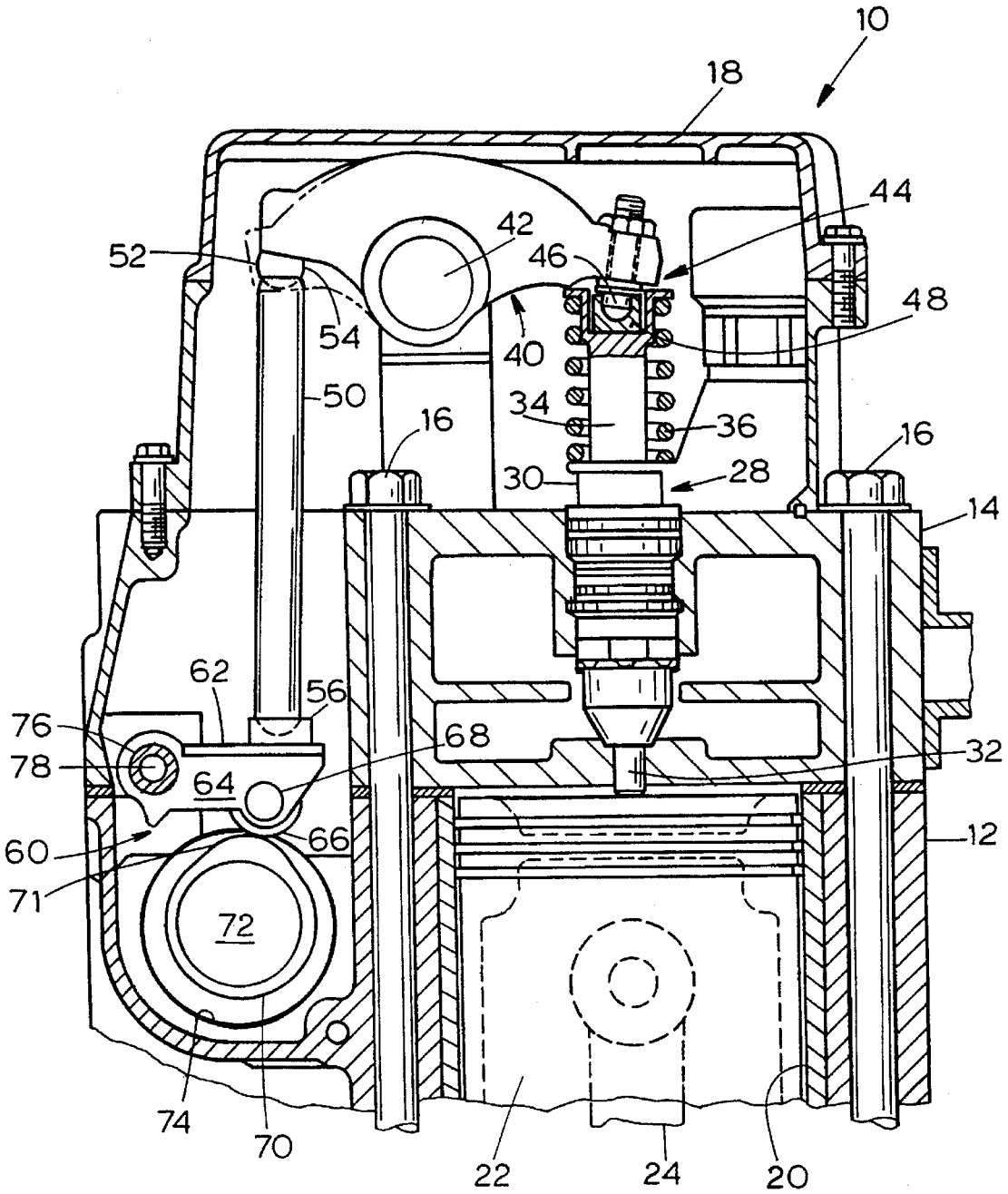
FIG. 1 illustrates a preferred embodiment of an engine assembly in accordance with the invention.

A preferred embodiment of an engine assembly 10 in accordance with the invention is illustrated in FIG. 1. The engine assembly 10 of FIG. 1 is generally similar to an engine assembly disclosed in U.S. Pat. No. 5,035,209 to Braker, et al., the disclosure of which is incorporated herein by reference.

Referring to FIG. 1, the engine assembly 10 includes an engine block 12, a cylinder head 14 attached to the engine block 12 via a plurality of bolts 16, and a valve cover 18 attached to the cylinder head 14. A plurality of cylinders 20 are formed in the engine block 12, and a piston 22 is disposed for reciprocating movement within each of the cylinders 20. Each piston 22 is coupled to a crankshaft (not shown) via a crank 24. A fuel injector 28 is disposed to periodically inject fuel into each cylinder 20. Each fuel injector 28 includes a body 30, a nozzle 32, a vertically reciprocable plunger 34, and a spring 36 for biasing the plunger 34 upwards.

Associated with each fuel injector 28 is a rocker arm 40 pivotally mounted on a shaft 42. Each rocker arm 40 has a first end mechanically coupled to the top of the fuel injector plunger 34 via a coupler 44 in the form of a pin 46 which is disposed within a cup-shaped receptacle 48 located in a cylindrical bore formed in the top of the plunger 34. Each rocker arm 40 has a second end mechanically coupled to a vertically disposed pushrod 50 via a pin 52 having a spherical head 54. The upper end of the pushrod 50 has a concave surface conformed to the shape of the spherical head 54.

The lower end of the pushrod 50 has a convex surface which is disposed within a cup 56 of a leaf-spring cam follower 60. The cup 56 is attached to a first portion of the cam follower 60 in the form of a flexible, substantially planar plate 62, the left end of which is fixably attached to the body 64 of the cam follower 60. The cam follower 60 has a cam roller 66 which is rotatably supported by a cylindrical support rod 68. The cam roller 66 engages and follows a cam 70 having a raised portion 71 and fixed to a camshaft 72 disposed within a bore 74. The left end of the cam follower 60 is supported for pivotal movement by a cylindrical shaft 76 which passes through a bore in the cam follower 60 and which has a hollow central portion 78 in which pressurized oil is provided.

Figure 2:
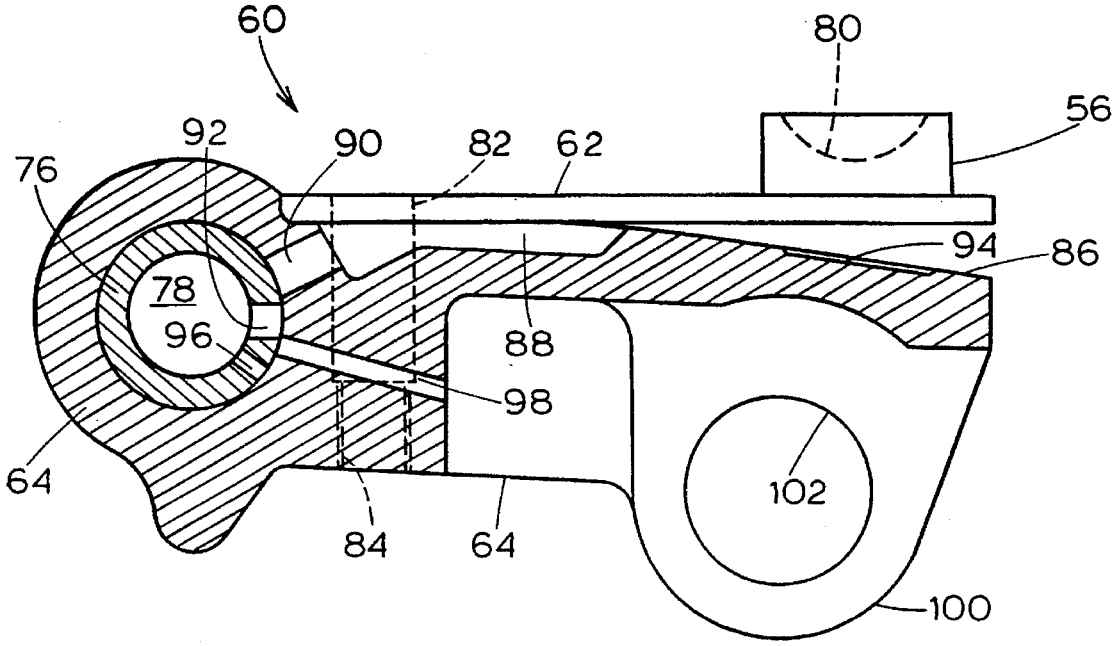
FIG. 2 is a cross-sectional view of one embodiment of a cam follower in accordance with the invention.
Figure 3:
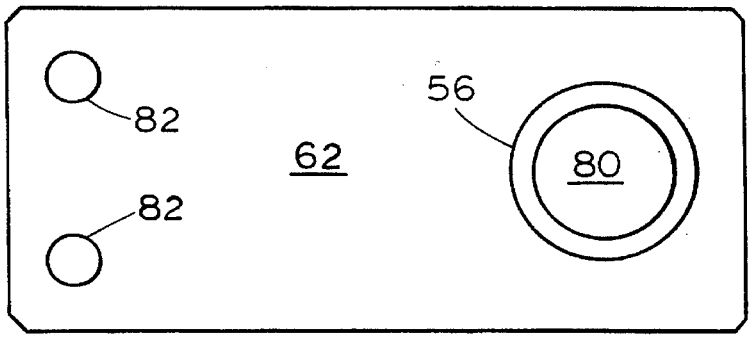
FIG. 3 is a top view of a portion of the cam follower of FIG. 2.
Figure 4:
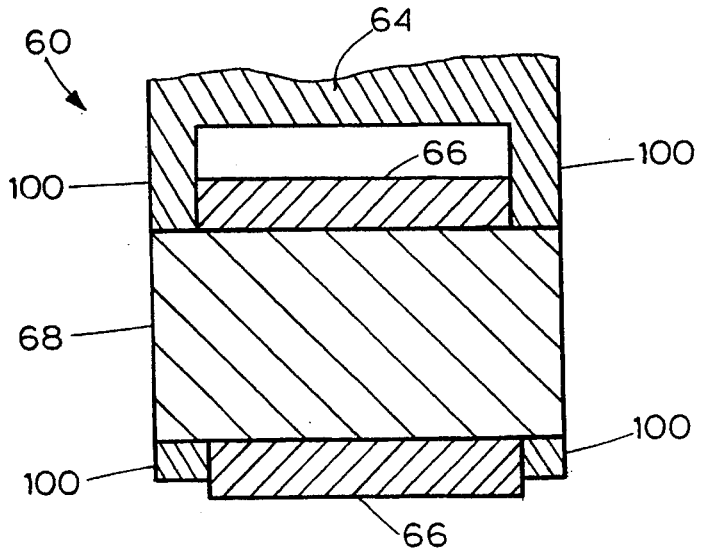
FIG. 4 is a cross-sectional side view of a portion of the cam follower of FIG. 2.

One preferred embodiment of the cam follower 60 generally shown in FIG. 1 is illustrated in FIGS. 2–4. Referring to FIGS. 2 and 3, the cup 56 of the cam follower 60 has a concave cavity 80 formed therein to support the convex bottom end of the pushrod 50. One end of the flexible plate 62 is attached to the body 64 of the cam follower 60 via a pair of bolts (not shown) which pass through a pair mounting holes 82 formed in the plate 62 and a respective pair of mounting bores 84 formed in the body 64.

The upper surface 86 of the cam follower body 64 is curved, so that when the flat plate 62 is attached to body 64 at the bores 82, 84, the right-hand end of the plate 62 is spaced from the upper surface 86 of the body 64. The plate 62 acts as a spring. In the absence of a vertical force tending to move the right end of the plate 62 towards the body 64, the plate 62 and body 64 occupy the position shown in FIG. 2. When such a vertical force of a threshold magnitude is present, the end of the plate 62 is forced against the upper surface 86 of the body 64, as shown in FIG. 1. As long as the flexible plate 62 is at least partially deflected towards the upper surface 86 of the body 64, the plate 62 will exert an upward force on the bottom end of the pushrod 50.

The cam follower 60 includes means for providing oil to the intersection of the flexible plate 62 and the cam follower body 64 to lubricate those two components. Pressurized engine oil is provided in the central hollow portion 78 of the shaft 76 to which the cam follower 60 is pivotally mounted. The cam follower 60 has a first oil cavity or reservoir 88 to which oil is periodically supplied via a cylindrical bore 90 which is periodically fluidly coupled to the central hollow portion 78 via a cylindrical bore 92 formed in the shaft 76.

Referring to both FIGS. 1 and 2, pressurized oil is supplied from the hollow portion 78 to the reservoir 88 when the two bores 90 and 92 are aligned, which occurs when the cam follower body 64 pivots downwardly (the position of the shaft 76 remains fixed) from its position shown in FIGS. 1 and 2. Oil may spill from the reservoir 88 to a second oil cavity or reservoir 94 formed in the upper surface 86 of the cam follower body 64.

Supplying oil between the bottom surface of the plate 62 and the upper surface 86 of the body 64 provides lubrication between those two components, damps the spring action of the flexible plate 62, and reduces noise resulting from the repeated contact between the underside of the flexible plate 62 and the upper surface 86 of the cam follower body 64.

Oil may also be provided to lubricate the cam roller 66 and the cam 70 by causing oil from the central hollow portion 78 of the shaft 76 to be sprayed towards those components when a bore 96 formed in the shaft 76 is aligned with a bore 98 formed in the cam follower body 64.

The manner in which the cam roller 66 is attached to the cam follower body 64 is illustrated in FIG. 4. The cam roller 66 (not shown in FIG. 2) is journalled between a pair of downwardly extending arms 100 integrally formed with the cam follower body 64 and rotatably supported by the support rod 68, which is press fit or otherwise conventionally fixed within a bore 102 (FIG. 2) formed in each of the arms 100. As shown in FIG. 4, the cam roller 66 has a cylindrical shape with a central bore through which the support rod 68 passes.

In operation, during each revolution of the camshaft 72, the raised portion 71 of the cam 70 forces the cam roller 66, the cam follower 60, and the pushrod 50 upwards. During this upwards movement of the cam follower 60, the upper surface 86 of the cam follower body 64 is forced against and makes contact with the underside of the flexible plate 62. The upwards movement of the upper end of the pushrod 50 causes the rocker arm 40 to rotate in a clockwise direction, causing the right-hand end of the rocker arm 40 to force the fuel injector plunger 34 downwards, causing fuel to be injected from the nozzle 32 into the cylinder 20.

As the raised portion 71 of the cam 70 rotates past the cam roller 66, the cam follower body 64 pivots downwardly about the shaft 76, and the bottom surface of the right-hand end of the flexible plate 62 moves away from the upper surface 86 of the cam follower body 64. As the downward movement of the cam follower body 64 continues, the pushrod 50 begins to move downwards, the rocker arm 40 pivots in a counter-clockwise direction, and the fuel injector plunger 34 moves upwards under the force of the spring 36.

During the downward movement of the pushrod 50, the upwards spring force exerted by the flexible plate 62 insures that all of the components of the injector train, including the cup 56 and the lower end of the pushrod 50, the upper end of the pushrod 50 and the pin 52, the rocker arm pin 46 and the cup-shaped receptacle 48, will maintain contact with each other. Consequently, any noise or knock due to those components repeatedly making contact with each other after being temporarily separated is reduced or eliminated.

The dimensions of the pushrod 50 and the cam follower 60 are preferably selected so that the flexible plate 62 is always at least slightly bent towards the cam follower body 64 so that the plate 62 always exerts an upwards spring force on the lower end of the pushrod 50.

Figure 5:
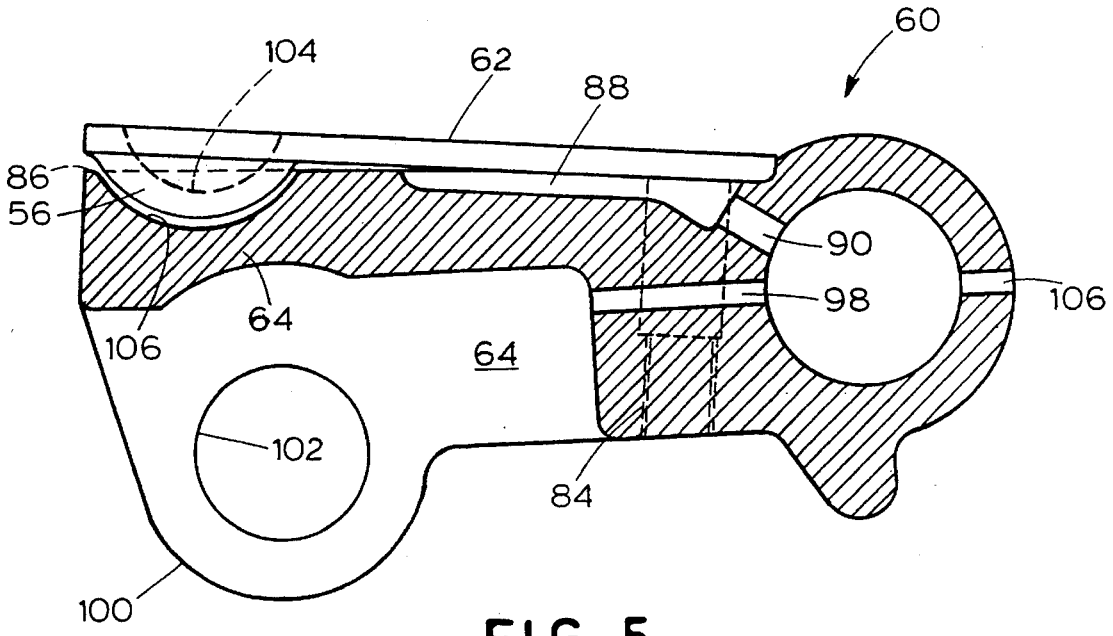
FIG. 5 is a cross-sectional view of a second embodiment of a cam follower in accordance with the invention.

A second embodiment of the cam follower 60 is shown in FIG. 5. The only significant difference in the cam follower 60 of FIG. 5 (other than being shown in a position reversed with respect to FIG. 2) is that the cup 56 in the flexible plate 62 is provided with a recessed cavity 104 disposed below the planar upper surface of the plate 62. Also, the relatively shallow oil cavity 94 of FIG. 2 has been replaced by a deeper, concave oil cavity 106 which also accommodates the lower convex portion of the recessed cavity 104. A bore 106, which is aligned with the bore 98, simply allows the bore 98 to be drilled, but does not perform any other function.

Industrial Applicability

The leaf spring cam follower described above can be utilized in any type of engine, including but not limited to gasoline engines or diesel engines having any number of cylinders, which utilizes a number of components which form an injector train and which might be temporarily separated during each fuel injection cycle.

We claim:

1. An engine assembly comprising:

an engine block having a cylinder disposed therein;

a fuel injector for periodically injecting fuel into said cylinder;

a pushrod;

a rocker arm disposed for periodic movement and having a first end and a second end, said first end of said rocker arm being disposed adjacent said fuel injector and said second end of said rocker arm being disposed adjacent said pushrod;

a cam shaft having a cam; and a cam follower operatively coupled between said cam and said pushrod, said cam follower having a first portion which supports a cam roller and a second portion which makes contact with said pushrod, said second portion of the cam follower comprises a flexible plate, said first and second portions of said cam follower being spring-biased with respect to each other.

2. An engine assembly as defined in claim 1 wherein said second portion of said cam follower additionally comprises a cup having a concave cavity attached to said flexible plate, said concave cup supporting said pushrod.

3. An engine assembly as defined in claim 2 wherein said first portion of said cam follower has an oil cavity disposed beneath said concave cup.

4. An engine assembly comprising:

an engine block having a cylinder disposed therein:

a fuel injector for periodically injecting fuel into said cylinder;

a pushrod;

a rocker arm disposed for periodic movement and having a first end and a second end, said first end of said rocker arm being disposed adjacent said fuel injector and said second end of said rocker arm being disposed adjacent said pushrod;

a cam shaft having a cam; and a cam follower operatively coupled between said cam and said pushrod, said cam follower having a first portion which supports a cam roller and a second portion which makes contact with said pushrod, said first and second portions of said cam follower being spring-biased with respect to each other;

means for supplying oil between said first and second portions of said cam follower; and said first portion of said cam follower has a bore disposed therein, wherein said first and second portions are joined at an intersection, and wherein said means for supplying oil between said first and second portions of said cam follower comprises:

a shaft having a hollow, oil-containing central portion, said shaft passing through said bore in said first portion; and a bore which fluidly connects said oil-containing central portion with said intersection of said first and second portions of said cam follower.

5. An engine assembly as defined in claim 4 wherein said means for supplying oil between said first and second portions of said cam follower additionally comprises an oil cavity formed in an upper surface of said first portion of said cam follower.

6. An engine assembly comprising:

an engine block having a cylinder disposed therein;

a fuel injector for periodically injecting fuel into said cylinder;

a pushrod;

a rocker arm disposed for periodic movement and having a first end and a second end, said first end of said rocker arm being disposed adjacent said fuel injector and said second end of said rocker arm being disposed adjacent said pushrod;

a cam shaft having a cam; and a cam follower operatively coupled between said cam and said pushrod, said cam follower having a first portion which supports a cam roller and a second portion which makes contact with said pushrod, said first and second portions of said cam follower being spring-biased with respect to each other;

said first portion of said cam follower comprises a rigid, curved member and said second portion of said cam follower comprises a flexible, substantially planar member.

7. An engine assembly comprising:

an engine block having a cylinder disposed therein:

a fuel injector for periodically injecting fuel into said cylinder;

a pushrod:

a rocker arm disposed for periodic movement and having a first end and a second end, said first end of said rocker arm being disposed adjacent said fuel injector and said second of said rocker arm being disposed adjacent said pushrod;

a rotatable camshaft having a cam fixed thereto, said cam undergoing rotation;

a pushrod-driving means coupled between said cam and said pushrod for causing said pushrod to undergo reciprocation in response to said rotation of said cam, said pushrod-driving means includes a cam follower having a first portion which supports a cam roller and a second portion which makes contact with said pushrod;

means for supplying oil between said first and second portions of said cam follower; and means for spring-biasing said pushrod against said second end of said rocker arm;

said first portion of said cam follower has a bore disposed therein, said first and second portions are joined at an intersection, and wherein said means for supplying oil between said first and second portions of said cam follower includes a shaft having a hollow, oil-containing central portion, said shaft passing through said bore in said first portion, and a bore which fluidly connects said oil-containing central portion with said intersection of said first and second portions of said cam follower.

8. An engine assembly as defined in claim 7 wherein said second portion of said cam follower additionally comprises a cup having a concave cavity attached to said flexible plate, said concave cup supporting said pushrod.

9. An engine assembly as defined in claim 8 wherein said first portion of said cam follower has an oil cavity disposed beneath said concave cup.

10. An engine assembly as defined in claim 7 wherein said means for supplying oil between said first and second portions of said cam follower additionally comprises an oil cavity formed in an upper surface of said first portion of said cam follower.

11. An engine assembly comprising:

an engine block having a cylinder disposed therein;

a fuel injector for periodically injecting fuel into said cylinder;

a pushrod;

a rocker arm disposed for periodic movement and having a first end and a second end, said first end of said rocker arm being disposed adjacent said fuel injector and said second end of said rocker arm being disposed adjacent said pushrod;

a camshaft having a cam;

a cam follower operatively coupled between said cam and said pushrod, said cam follower having a first portion which supports a cam roller and a second portion which makes contact with said pushrod, said first and second portions of said cam follower being spring-biased with respect to each other, said first portion of said cam follower comprising a rigid, curved member and said second portion of said cam follower comprising a flexible, substantially planar member; and means for supplying oil between said first and second portions of said cam follower.

12. An engine assembly as defined in claim 11 wherein said second portion of said cam follower additionally comprises a cup having a concave cavity attached to said flexible plate, said concave cup supporting said pushrod.

13. An engine assembly as defined in claim 12 wherein said first portion of said cam follower has an oil cavity disposed beneath said concave cup.

14. An engine assembly as defined in claim 11 wherein said first portion of said cam follower has a bore disposed therein, wherein said first and second portions are joined at an intersection, and wherein said means for supplying oil between said first and second portions of said cam-follower comprises:

a shaft having a hollow, oil-containing central portion, said shaft passing through said bore in said first portion, and a bore which fluidly connects said oil-containing central portion with said intersection of said first and second portions of said cam follower.

15. An engine assembly as defined in claim 14 wherein said means for supplying oil between said first and second portions of said cam follower additionally comprises an oil cavity formed in an upper surface of said first portion of said cam follower.

* * * * *